US006932015B2

(12) United States Patent
Storvoll et al.

(10) Patent No.: US 6,932,015 B2
(45) Date of Patent: Aug. 23, 2005

(54) MOORING ARRANGEMENT

(75) Inventors: Eirik Storvoll, Arendal (NO); Arild Bech, Arendal (NO); Carl Arnet, Arendal (NO)

(73) Assignee: Advanced Production and Loading AS, Kolbjornsvik (NO)

( * ) Notice: Subject to any disclaimer, the term of this patent is extended or adjusted under 35 U.S.C. 154(b) by 0 days.

(21) Appl. No.: 10/501,757

(22) PCT Filed: Jan. 13, 2003

(86) PCT No.: PCT/NO03/00007

§ 371 (c)(1),
(2), (4) Date: Dec. 3, 2004

(87) PCT Pub. No.: WO03/059728

PCT Pub. Date: Jul. 24, 2003

(65) Prior Publication Data

US 2005/0106959 A1 May 19, 2005

(30) Foreign Application Priority Data

Jan. 17, 2002 (NO) ..... 2002-0265

(51) Int. Cl.[7] ..... B63B 21/00

(52) U.S. Cl. ..... 114/230.13; 441/5; 405/195.1

(58) Field of Search ..... 441/5; 114/230.1, 114/230.13; 405/195.1

(56) References Cited

U.S. PATENT DOCUMENTS 3,722,223 A 3/1973 Gratz ..... 61/46
3,916,812 A 11/1975 Bartels ..... 114/230
4,010,500 A * 3/1977 Reid, Jr. ..... 441/5

(Continued)

FOREIGN PATENT DOCUMENTS

GB 1554881 10/1979

OTHER PUBLICATIONS

PCT International Preliminary Report for PCT/NO2003/00007, 5 pages, Apr. 16, 2004.
PCT International Search Report PCT/NO03/00007, mailed Mar. 29, 2003.

*Primary Examiner*—Jesus D. Sotelo
(74) *Attorney, Agent, or Firm*—Baker Botts L.L.P.

(57) ABSTRACT

Arrangement for mooring, loading and unloading of a vessel, comprising: a stationary inner tower with a lower end fixedly anchored to the seabed, from where the inner tower extends upwards through the sea to an upper end over the sea level, which inner tower at level close to the seabed has through connections for hoses and cables for transfer of load and signals, which hoses and cables are brought further up through the inner tower and out of its upper end; a yoke that in one end is rotatably fastened to the inner tower, wherefrom the yoke extends further outwards to at least one outer ballastable end wherefrom moorings are arranged to keep the vessel anchored, on which vessel devices are provided to connect the vessel with the moorings and said hoses and cables for transfer of load and signals. The mooring arrangement is distinguished in that it further is comprising an outer tower with rotatable fastening to the inner tower, which outer tower from the fastening to the inner tower extends upwards outside the inner tower to a level over the upper end of the inner tower, wherein the rotatable fastening is placed below sea level and also is comprising the fastening of the yoke, such that the outer tower and the yoke as one unit is freely rotatable over and around the inner tower that is stationary anchored to the seabed; and a swivel provided between the upper end of the inner tower and the upper end of the outer tower, for rotatable transfer of load and signals with said hoses and cables between the inner and the outer tower and therefrom further to the vessel.

6 Claims, 2 Drawing Sheets

U.S. PATENT DOCUMENTS 4,226,204 A 10/1980 Tuson ..... 114/230
4,351,260 A * 9/1982 Tuson et al. ..... 114/230.14
4,516,942 A 5/1985 Pedersen ..... 441/5
4,546,721 A 10/1985 Langrock ..... 114/230

* cited by examiner

FPSO
CHUTE
FLEXIBLES
ICE BREAKER
YOKE
HANGOFF STRUCTURE
BALLAST TUBE
ELEVATION SYS
CLOSEUP ON STRUCTURE

MOORING ARRANGEMENT

RELATED APPLICATIONS

This application is the national phase United States Application of International Application No. PCT/NO03/00007 filed on Jan. 13, 2003, which claims priority to Norwegian Patent Application Serial No. 2002 0265 filed on Jan. 17, 2002.

FIELD OF THE INVENTION

The present invention regards arrangements for mooring, loading and unloading of a vessel. The vessel is for example a FPSO-vessel ("Floating Production Storage and Offloading"), but can be a tanker or another type of vessel. The load is preferably comprising hydrocarbons in form of oil or gas, but can be any fluid or for example powder that can be transported through pipes. The invention is in particular relevant for mooring, loading and unloading of a vessel of the FPSO-type at shallow waters.

BACKGROUND OF THE INVENTION AND PRIOR ART

For mooring, loading and unloading of a vessel at shallow waters, for example a vessel of the FPSO-type, it has proved difficult to arrange anchor chains with sufficient slack such that a suitable resilience is achieved in the mooring system. At too low resilience in the mooring system, sudden vessel movements may result in too large forces. Another crucial factor regarding mooring is to achieve a position restoring force in the mooring, such that the vessel as moored can lay in a stable position during loading and unloading without occurrence of too strong forces.

Regarding conventional single anchoring systems with a floating buoy connected with a chain or a connection arm to a foundation structure fastened to the seabed, it has proved that the position restoring forces are insufficient.

Completely submerged systems for mooring and transfer of load and signals are possible, but significant problems appear in that critical components are submerged in the sea. This shortens the lifetime significantly and results in severe problems with respect to repair and maintenance.

In view of the above, mooring, loading and unloading at shallow waters are preferably undertaken by use of a mooring tower that extends from the seabed and up to above sea level, with a sufficiently resilient anchoring of the vessel to the top of the mooring tower.

Patent publication U.S. Pat. No. 4,516,942 contains description of a mooring tower that extends from the anchoring at the seabed to over the sea level, where the tower is provided with a triaxial rotatable yoke in the top in the mooring tower, for mooring and transfer of fluid and signals. The yoke's fastening in the top of the mooring tower results in that the mooring tower is subject to a very large momentum from the mooring forces, and the dimensioning of the mooring tower is therefore very powerful. Also the vessel that is to be moored to the mooring tower according to U.S. Pat. No. 4,516,942 must have a powerful dimensioning in order to handle the forces involved, in particular since the main structure of the vessel has to take up forces from the yoke from above deck level. The volume of the mooring tower and the yoke above the water line and down to the deepest draught for vessels in the waters is very significant, resulting in risk for collision and heavy impact from ice, current, waves and wind. As apparent from the above a number of disadvantages are associated with the mooring tower according to U.S. Pat. No. 4,516,942.

The objective of the present invention is to provide an arrangement for mooring without the disadvantages associated with the mooring tower according to patent U.S. Pat. No. 4,516,942 and other relevant prior art, as referred to above.

SUMMARY OF THE INVENTION

The objective of the present invention is met in that a mooring arrangement is provided, having design and distinguishing features as apparent from claim 1.

With the arrangement for mooring according to the present invention the mooring forces providing momentum on the mooring tower are significantly reduced, with resulting consequences for the dimensioning of the mooring tower and the anchoring to the seabed. The momentum of the mooring forces on the mooring tower can be zero at particularly preferred embodiments involving that the resultant of the mooring forces is in line through the anchoring in the seabed. With the arrangement for mooring according to the present invention also the risk for collision with the vessel that is to be moored is reduced, in particular by placing the yoke lower than the maximum draught of the vessel. The reduced dimensions of the mooring tower are reducing the impact from ice, current, waves and wind.

DRAWINGS

DETAILED DESCRIPTION

In the following a particular embodiment is further described with reference to the drawings. In this connection only mooring, loading and unloading with a typical FPSO-vessel is considered.

Figures 1, 2, 3:
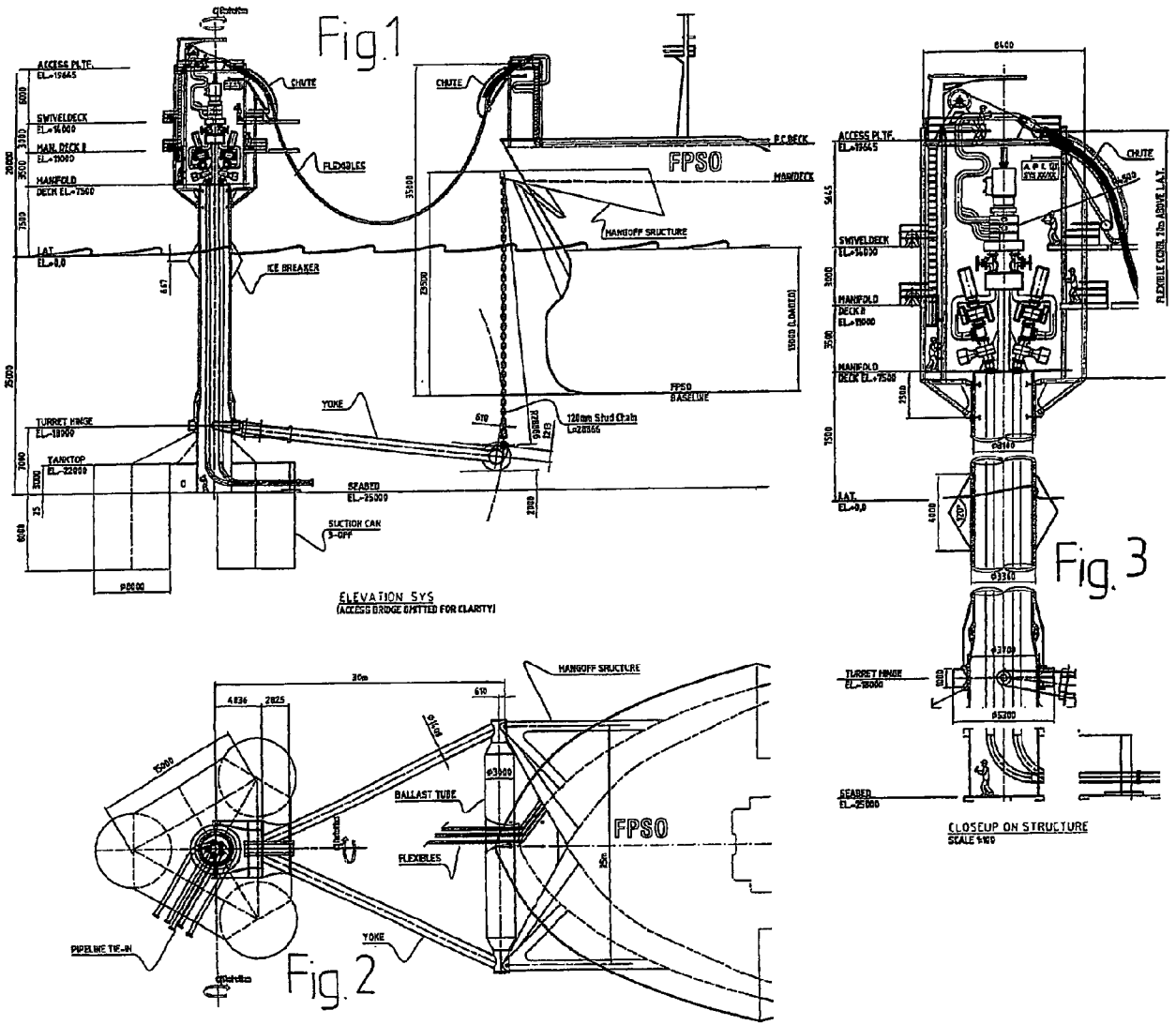
FIG. 1 shows a side view of the arrangement for mooring according to the invention, with a FPSO-vessel as moored.
FIG. 2 shows a top view of FIG. 1.
FIG. 3 shows an enlarged section of the mooring tower illustrated on FIG. 1.

FIG. 1 illustrates an embodiment of the arrangement according to the invention, with a FPSO-vessel as anchored, whereby the arrangement is illustrated for a water depth of 25 m and with a FPSO with storage capacity of about 1000000 bbl (160000 $m^3$). The draught of the vessel is 8.0 m with ballast and 15.0 m fully loaded, the length is 265 m and the breadth is 42.5 m. This is of course only for illustration and scaling to other dimensions or vessels can be undertaken according to demand.

The arrangement according to the invention is in general most useful for water depths from 20 m to 50 m, but the limits are not fixed. The arrangement is completely making use of known components that all are well proven and have exhibited long service life without need for maintenance. Yet the arrangement and all critical components are designed such that inspection is simple and replacement of critical components is possible. The design life will be chosen to a minimum of 15 years for the illustrated embodiment.

FIG. 1 shows, as mentioned, a typical FPSO laying moored to the arrangement according to the invention, with hoses and moorings connected to the buoy of the vessel. The hoses for transfer of load, including cables for transfer of signals, extend out from the vessel via a bending restrictor and hang as catenary lines towards a corresponding bending restrictor at the top of the outer tower of the arrangement according to the is invention. The vessel is connected via a mooring fastening structure in the buoy with moorings to the ends of a yoke that is placed submerged under water. As illustrated on the figure the yoke is fastened to the inner tower at a height of 7.0 m over the seabed. The vessel can rotate freely around the inner tower with the yoke, the outer tower, the moorings, hoses and cables.

The position restoring effect of the mooring arrangement is increased by ballast provided between the outer arms of the yoke. In the illustrated embodiment the ballast is a 25 m long cylinder of diameter 3 m, divided into three compartments. After installation the central compartment of the ballast cylinder is water filled while the two side compartments are filled with heavy slurry to provide suitable pretensioning of the moorings.

Between the top of the outer tower and top of the inner tower a swivel connection is provided to achieve rotatable transfer of load and signals. The swivel deck on FIG. 1 is at elevation 14 m. The swivel comprises a process swivel, a swivel for electrical power and electrical and optical signals, and a swivel for the hydraulics. All seals are designed as double barrier seals. Means will be provided for inert gas purging or similar for rooms with swivels, for pressure monitoring and pressure control. Also emergency shut-down systems for fluids and electrical signals will be provided.

The number of hoses and cables is in principle without any particular limit. When the expression hoses here is used it is considered to mean both stiff pipes and flexible pipes, except from the distance between the top of the outer tower and the vessel where hoses or pipes have to be flexible because they are hanging as catenary lines above the water level.

A typical tower will for example comprise two 12 inch hoses or pipes for loading of crude oil, a 12 inch flexible pipe for water injection, and an additional reserve pipe of 12 inch. The number, the types and dimension of pipes, hoses or cables can of course be varied according to the demand. As illustrated on FIG. 1, and appearing more clearly on FIG. 3, the inner of the mooring tower is open to the atmosphere and is dry for personnel access. The view of FIG. 1 and FIG. 2 as combined illustrates both the design of the yoke and the inner tower. The inner tower is fixedly fastened to the seabed. Three suction anchors are illustrated in triangular configuration with 15 m between each suction anchor, wherein each suction anchor, having a diameter of 8 m, is to penetrate 8 m into the seabed. The design as illustrated is considered to be sufficiently powerful to hold a FPSO of the specified size passively anchored in a 100 years condition of harsh weather, whereby the vessel is without available motor power. However, it is possible to use other types of anchoring to the seabed, provided that the dimensioning is according to the acting forces. Suction anchors are preferable with respect to installation, fastening force with respect to volume, difficult soil conditions and possible removal after use. Suction anchors can relatively easy be installed and later be removed.

The outer tower with all connected equipment and the yoke can weathervane freely with the vessel around the stationary inner tower fixedly anchored to the seabed, under all weather conditions.

The arrangement according to the present invention further comprises equipment over the sea-line or placed dry within the tower, which equipment is easily accessible for inspection and maintenance, and said equipment is preferably of known type for rotatable communication of fluid and signals, and mechanical transfer. The tower structure provides dry placement of said equipment and supports the connections for load transfer and signal transfer, which are hanging as catenary lines about 20 m over the sea level.

With the arrangement according to the present invention the anchoring forces are transferred via the yoke to the seabed via the rotatable fastening, which in the illustrated embodiment is a rotatable disc. The rotatable fastening of the yoke and the outer tower is the only critical component that is not placed dry in the arrangement according to the present invention.

Some further details regarding some of the components are as follows:

The inner tower with mounted rotatable disc over a fast anchoring to the seabed represents the stationary part of the arrangement according to the invention and supports all the equipment above. The inner tower takes up the forces acting on the outer tower because of ice, wind, current, the hanged-up hoses, etc., which forces are transferred from the outer tower via bearings along the length between the towers. The bearings can be designed with sliding surfaces manufactured from Inconel cladded steel. The diameter on the lower part of the inner tower below the rotatable disc is according to the illustrated embodiment 3.7 m, while the diameter of the upper part of the inner tower is 3.1 m.

On the outside of the outer tower, at the water-line level, an ice-breaking device is installed.

Disconnection of the whole mooring arrangement is possible within 48 hours, for example at very severe ice conditions. The arrangement is, however, designed to withstand the worst 100 years conditions of ice.

A footbridge can be installed between the vessel and the tower structure, for use at moderate or better weather conditions.

The rotatable disc has the outer tower mounted with bolts. The rotatable disc has a protrusion to which the yoke is fastened. The rotatable disc is preferably of a well known type according to the so called "STL/STP-system". The bearing means comprises a main radial bearing encompassing the inner tower and an upper axial bearing and a lower axial bearing. Preferably a self lubricating bearing system of the type Oiles 500 is used, with bronze alloy bearings with PTFE-lubrication, chosen for long service life. The bearings are fixed to the rotatable disc. The upper bearing ring supporting the upper axial bearing is locked to the stationary inner tower by use of a segment locking system fastened in a circular groove on the centre shaft. This is a well proven solution used with good results for swivels subsea, according to the SAL-systems.

Figure 4:
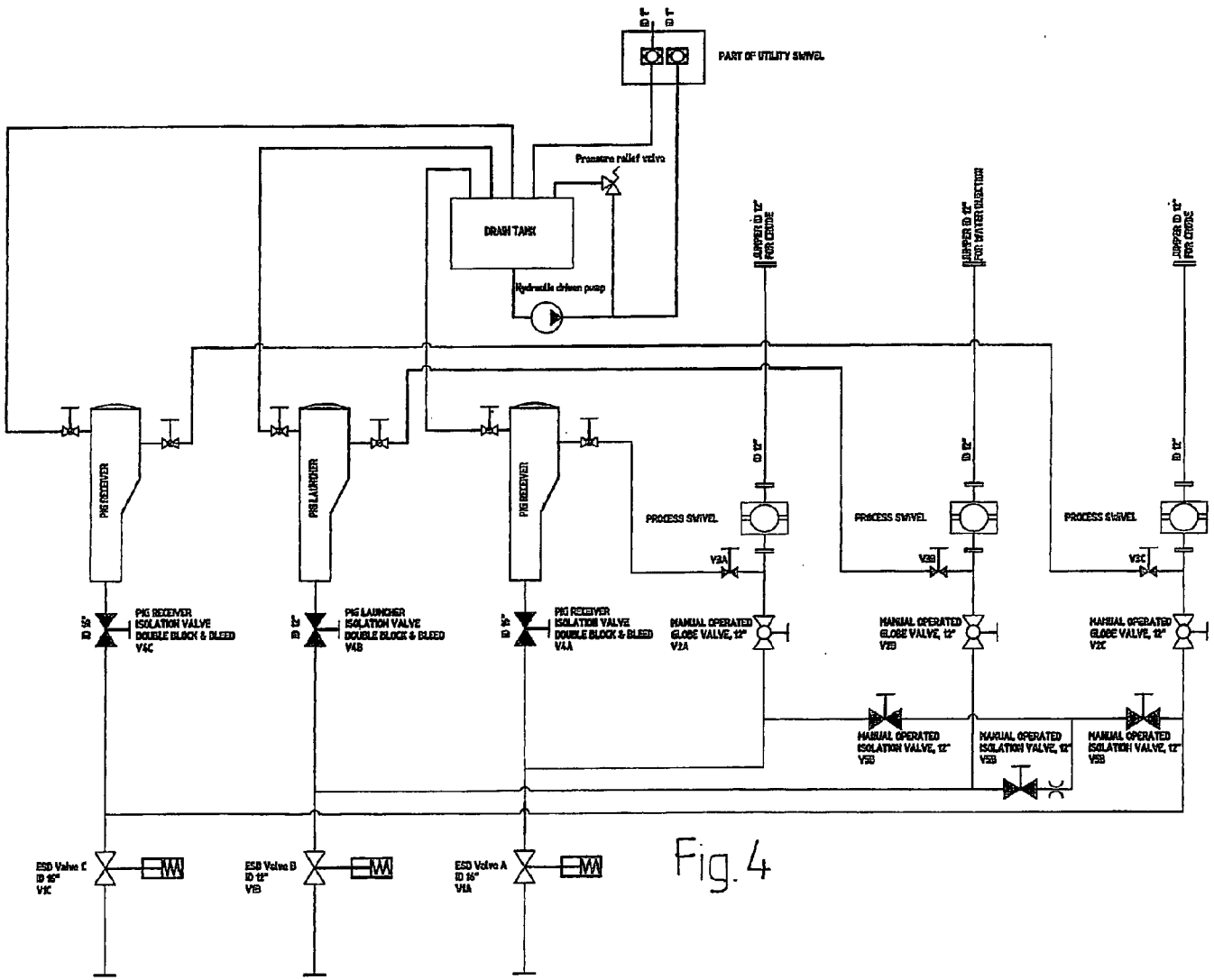
FIG. 4 is a process diagram for the mooring arrangement.

The fluid transfer system is also illustrated on FIG. 4 where a typical process flow diagram is indicated. As apparent, means are also provided for pigging of the load transferring lines and the water injection hose.

Installation and deinstallation is relatively simple because of the suction anchors and large compartments that can be filled with air or ballasted in a controlled way, and by installing the yoke after installation of the tower structure. Then pipes and hoses are installed. It is estimated that 7–8 m water depth is required in order to tow a tower structure as the one illustrated, when it is floating by use of suitable air filling. Preferably a crane vessel, divers and remotely operated vehicles are used in connection with installation and deinstallation.

What is claimed is:

1. An arrangement for mooring, loading and unloading of a vessel, comprising:

a stationary inner tower with a lower end fixedly anchored to the seabed, from where the inner tower extends upwards through the sea to an upper end over the sea level, which inner tower at level close to the seabed has through connections for hoses and cables for transfer of load and signals, the hoses and cables brought further up through the inner tower and out the upper end, a yoke having one end rotatably fastened to the inner tower, wherefrom the yoke extends further outwards to at least one outer ballastable end wherefrom moorings are arranged to keep the vessel anchored, on which vessel devices are provided to connect the vessel with the moorings and said hoses and cables for transfer of load and signals, an outer tower having a rotatable fastening to the inner tower, the outer tower from the fastening to the inner tower extending upwards outside the inner tower to a level over the upper end of the inner tower, the rotatable fastening placed below sea level and further comprising the fastening of the yoke, such that the outer tower and yoke as one unit is freely rotatable over and around the inner tower that is stationary anchored to the seabed, and a swivel provided between the upper end of the inner tower and the upper end of the outer tower for rotatable transfer of load and signals with the hoses and cables between the inner tower, the outer tower and the vessel.

2. The mooring arrangement according to claim 1 further comprising the rotatable fastening of the outer tower and the yoke located at a depth level deeper than the largest draught for the vessel proximate the lower end of the inner tower and a short distance over the seabed.

3. The mooring arrangement according to claim 1 further comprising the rotatable fastening of the outer tower and the yoke, the placement thereof, the length of the yoke and the length of the moorings with the vessel anchored for loading and unloading, dimensioned such that an extension of the longitudinal axis of the yoke penetrates the stationary anchoring in the seabed.

4. The mooring arrangement according to claim 1 wherein the rotatable fastening of the outer tower and the yoke further comprises a rotatable disc with fixed self lubricating bearings having a main radial bearing, an upper axial bearing and a lower axial bearing.

5. The mooring arrangement according to claim 1 further comprising the yoke formed as a triangle with a top point fastened to the inner tower and two outer ends between which outer ends ballast chambers are provided and from which two outer end moorings are provided to hold the vessel anchored.

6. The mooring arrangement according to claim 1, further comprising the yoke fastened to a protrusion in a rotatable disc that is rotatable around the inner tower, the yoke rotatably bolted to the protrusion with a fastening bolt with a longitudinal axis parallel with the plane of the rotatable disc and tangential to the rotation axis of the rotatable disc, and wherein the yoke includes a rotatable pin provided outside the roatatble disc in the longitudinal axis of the yoke for rotation around the longitudinal axis, such that the yoke is moveable around three axes.

* * * * *